US006425809B1

(12) United States Patent
Ichimura

(10) Patent No.: US 6,425,809 B1
(45) Date of Patent: Jul. 30, 2002

(54) POLISHING APPARATUS

(75) Inventor: Teruhiko Ichimura, Kanagawa-ken (JP)

(73) Assignee: Ebara Corporation, Tokyo (JP)

( * ) Notice: Subject to any disclaimer, the term of this patent is extended or adjusted under 35 U.S.C. 154(b) by 0 days.

(21) Appl. No.: 09/504,619

(22) Filed: Feb. 15, 2000

(30) Foreign Application Priority Data

Feb. 15, 1999 (JP) ..... 11-035640
Feb. 15, 1999 (JP) ..... 11-035641

(51) Int. Cl.[7] ..... B24B 5/00
(52) U.S. Cl. ..... 451/287; 451/41
(58) Field of Search ..... 451/41, 285, 287, 451/288, 289, 386, 387, 397, 398, 259, 268, 269

(56) References Cited

U.S. PATENT DOCUMENTS 5,635,083 A 6/1997 Breivogel et al.
5,681,215 A 10/1997 Sherwood et al. ..... 451/388
5,795,215 A 8/1998 Guthrie et al. ..... 451/286
5,885,135 A 3/1999 Desorcie et al. ..... 451/41
5,941,758 A 8/1999 Mack
5,961,375 A * 10/1999 Nagahara et al. ..... 451/41
6,024,630 A * 2/2000 Shendon et al. ..... 451/41
6,056,632 A * 5/2000 Mitchel et al. ..... 451/288
6,077,153 A * 6/2000 Fujita et al. ..... 451/259
6,080,049 A * 6/2000 Numoto et al. ..... 451/285
6,110,025 A * 8/2000 Williams et al. ..... 451/286
6,183,354 B1 * 2/2001 Zuniga et al. ..... 451/285

FOREIGN PATENT DOCUMENTS

JP 2000326215 A * 11/2000 ..... B24B/37/04

* cited by examiner

*Primary Examiner*—Joseph J. Hail, III
*Assistant Examiner*—David B. Thomas
(74) *Attorney, Agent, or Firm*—Wenderoth, Lind & Ponack, L.L.P.

(57) ABSTRACT

A polishing apparatus for polishing a plate-like member such as semiconductor wafer with a high degree of polished surface flatness is provided. The apparatus comprises a turntable having a surface provided on its upper surface with a polishing pad having an upper or polishing surface, and a carrier having an article holding surface for holding thereon a plate-like article. The carrier is adapted to press a surface of the plate-like article against the polishing surface of the polishing pad to polish and flatten the surface of the plate-like article by relative movement between the article and the polishing surface. An annular member is provided along the peripheral edge of the plate-like article between the article holding surface and the plate-like article to form a chamber therebetween, and a pressurized fluid source is fluidly connected to the chamber for supplying a pressurized fluid into the chamber. The polishing surface of the polishing pad is provided with grooves to divide the polishing surface into a number of sections. The chamber may be divided into outer and inner chamber sections so that the pressures in those chamber sections can be controlled, respectively.

18 Claims, 15 Drawing Sheets

POLISHING APPARATUS

BACKGROUND OF THE INVENTION

The present invention relates to a polishing apparatus for polishing a plate-like article such as a semiconductor wafer.

With recent rapid progress in technology for fabricating high-integration semiconductor devices, circuit wiring patterns have been becoming increasingly fine, with spaces between wiring patterns also decreasing. As wiring spacing decreases to a level less than 0.5 microns, the depth of focus in circuit pattern formation in photolithography and the like becomes shallower. Accordingly, surfaces of semiconductor wafers on which circuit pattern images are to be formed by a stepper are required to be polished by a polishing apparatus to have an exceptionally high degree of surface flatness.

FIG. 1 shows a conventional polishing apparatus for making the surface of a semiconductor wafer flat. The apparatus includes a turntable 101 provided with a polishing cloth 102 on the upper surface thereof, a wafer carrier 105 for carrying a semiconductor wafer 103 to be polished and an abrasive liquid supply nozzle 108 for supplying an abrasive liquid Q onto the polishing surface. The wafer carrier 105 is drivingly connected to a rotatable drive shaft 109 and is provided on its lower surface with a resilient backing member 107 formed from polyurethane or the like so that the semiconductor wafer 103 is supported on the backing member 107 with the entire upper surface of the semiconductor wafer engaged with the backing member 107.

Further, the wafer carrier 105 is provided therearound with a guide ring 106 to prevent the wafer 103 from becoming disengaged from the lower surface of the backing member 107. The guide ring 106 is fixedly secured to the wafer carrier with the lower surface of the guide ring 106 positioned at a lower level relative to the lower surface of the baking member 107, whereby the semiconductor wafer 103 is securely held under the lower surface of the backing member.

During a polishing operation, the wafer carrier 105 holds the wafer 103 on the lower surface of the backing member 107 and presses it against the polishing cloth 102 on the turntable 101 while the wafer carrier 105 and the turntable 101 are turned about their axes, respectively. Simultaneously, the abrasive liquid nozzle 108 supplies an abrasive liquid Q on the polishing cloth 102. The abrasive liquid consists of, for example, an alkaline slurry containing abrasive particles which chemically and mechanically polishes the semiconductor wafer by means of both the alkali and the abrasive particles.

Since, in such a conventional polishing apparatus, the semiconductor wafer 103 is engaged across its area with the backing member 107 when subjected to the polishing operation, the semiconductor wafer is readily affected by inconsistencies in the hardness of the backing member 107, thereby making it difficult for the semiconductor wafer 103 to be polished uniformly.

Further, since the polishing cloth provided on the turntable 101 is formed from a resilient member such as IC1000/SUBA400(IC1000 with 1,000 punched holes) produced by Rodel Nitta Corp., when the polishing cloth 102 is disengaged from the semiconductor wafer 103 the polishing cloth tends to rebound or spring back against the wafer, whereby an edge of the semiconductor wafer comes into engagement with a portion of the polishing cloth under a strong pressure, resulting, as shown in FIG. 2, in excessive polishing.

FIG. 3 is a graph showing the thickness A of an oxide layer of a 6 inch diameter semiconductor wafer polished by a conventional polishing apparatus, which thickness was measured at a number of points along a radius of the semiconductor wafer, and pressures B imposed on the semiconductor wafer at points on the radius during polishing of the semiconductor wafer. The values of the pressures were calculated through the so-called finite element method. It can be noted from the graph that the values denoting the pressures generally correspond to the values denoting the thickness of the oxide layer. It has been confirmed that a similar tendency exists with respect to a semiconductor wafer having an 8 inch diameter in terms of the above-stated oxide layer thickness and pressures.

SUMMARY OF THE INVENTION

Accordingly, it is an object of this invention to provide a polishing apparatus whereby a plate-like article such as a semiconductor wafer is polished to have a uniformly high degree of flatness.

According to the present invention, a polishing apparatus comprises a turntable having a flat surface, and a flat polishing pad provided on the flat surface of the turntable. The polishing pad has a polishing surface provided with grooves formed therein to divide the polishing surface into a number of sections. The apparatus further comprises an article carrier having an article holding surface for holding thereon a plate-like article having a surface to be polished. The carrier is adapted to press the surface of the plate-like article against the polishing surface of the polishing pad and to polish and flatten the surface of the plate-like article by relative movement between the article and the polishing surface. An annular member is positioned between the article holding surface and the plate-like article to form a chamber defined by the annular member, the article holding surface and the plate-like article, and a pressure control system is fluidly connected to the chamber for controlling pressure in the chamber. The annular member may be positioned along the peripheral edge of the plate-like article. The grooves may be arranged in a grid-like pattern.

The plate-like article is pressed against the polishing surface under a pressure exerted by the pressurized fluid while pressing the plate-like article against the polishing surface through the annular member.

The annular member may have a width in a range of from 10 mm to 20 mm. According to another aspect of the present invention, a polishing apparatus comprises a turntable having a surface, and a polishing pad provided on the surface of the turntable. The polishing pad has a polishing surface. The apparatus further comprises an article carrier having an article holding surface for holding thereon a plate-like article having a surface to be polished. The carrier is adapted to press the surface of the plate-like article against the polishing surface of the polishing pad and to polish and flatten the surface of the plate-like article by relative movement between the article and the polishing surface. An annular member is positioned between the article holding surface and the plate-like article to form a chamber defined by the annular member, the article holding surface and the plate-like article. The annular member has a width in the range of from 10 mm to 20 mm, and a pressure control system is fluidly connected to the chamber for controlling the pressure in the chamber. The annular member may be positioned along the peripheral edge of the plate-like article.

According to a further aspect of this invention, a polishing apparatus comprises a turntable having a surface, and a polishing pad provided on the flat surface of the turntable. The polishing pad has a polishing surface. The apparatus further comprises an article carrier having an article holding surface for holding thereon a plate-like article having a surface to be polished. The carrier is adapted to press the surface of the plate-like article against the polishing surface of the polishing pad and to polish and flatten the surface of the plate-like article by relative movement between the article and the polishing surface. An outer member in the shape of a ring is placed between the article holding surface and the plate-like article to form a chamber defined by the outer member, the article holding surface and the plate-like article, and an inner member is positioned inwardly of the outer member between the article holding surface and the plate-like article to divide the chamber into a plurality of chamber sections separated from each other. The polishing apparatus may further includes a pressure control system fluidly connected to the chamber for controlling pressures in the chamber sections. The outer member may be positioned along the peripheral edge of the plate-like article.

The inner member may be in the form of a ring and positioned coaxially with the outer member to divide the chamber into outer and inner chamber sections. The pressure control system may include regulators for controlling the pressures in the inner and outer chamber sections such that a pressure in the inner chamber is made greater than that in the outer chamber.

It is preferable that for the outer member is to have a width which is greater than that of the inner member. Further, it is preferable for a ratio of the pressure in the inner chamber section to the pressure in the outer chamber to be set to be 1:0.5–1:0.8. The outer and inner members may be formed from a non-permeable material such as silicon rubber, polyethylene terephthalate, polyurethane, polyethylene and resist film.

In accordance with a further aspect of the present invention, there is provided a polishing apparatus comprising a turntable having a surface, a polishing pad provided on the surface of the turntable, an article carrier having an article holding surface for holding thereon a plate-like article having a surface to be polished, and a backing member positioned between the article holding surface and the plate-like article to form a space between the holding surface and the plate-like article. The member is formed from a polyethylene terephthalate sheet.

These and other features and advantages of the present invention will become apparent from the following detailed description of the invention when taken in conjunction with the accompanying drawings wherein like reference numerals designate like or corresponding elements throughout the several views.

BRIEF DESCRIPTION OF THE DRAWINGS

FIG. 7(*b*) is an enlarged view of a portion of the polishing pad of FIG. 7(*a*).

DETAILED DESCRIPTION OF THE PREFERRED EMBODIMENTS

Figure 4:
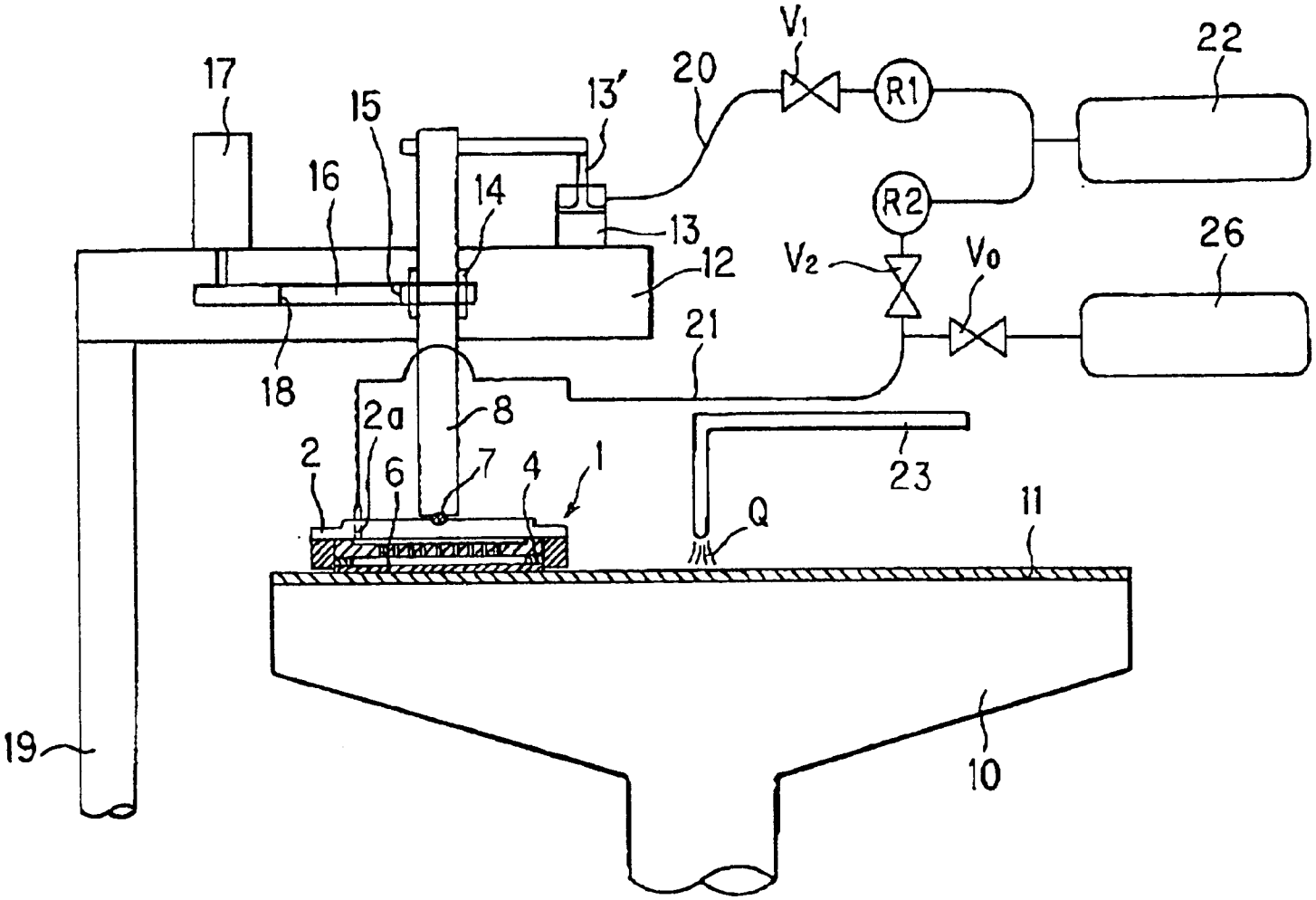
FIG. 4 is a schematic view of a polishing apparatus in accordance with the instant invention.

With reference to FIG. 4, there is shown a polishing apparatus in accordance with a first embodiment of this invention.

Figure 5:
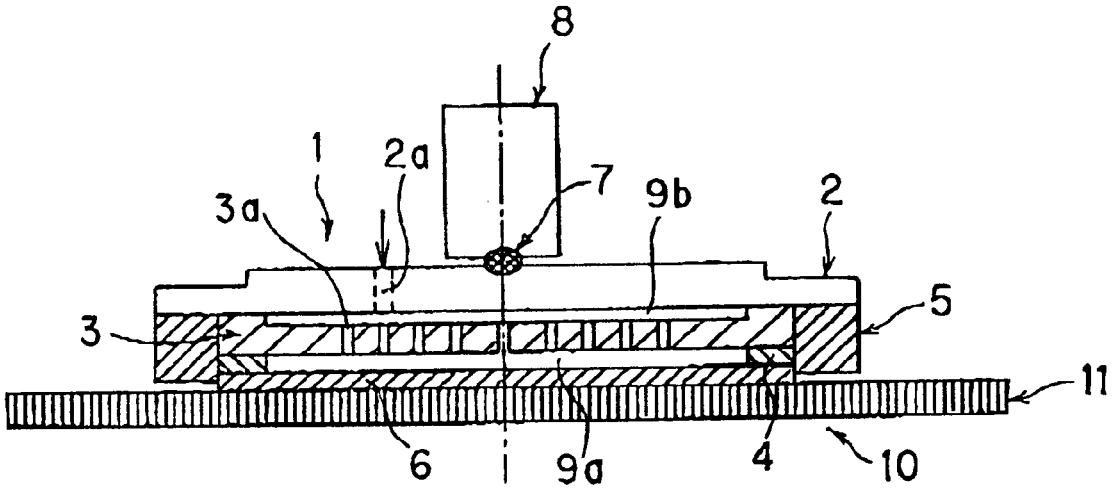
FIG. 5 is a wafer carrier employed in a polishing apparatus in accordance with a first embodiment of this invention.

As shown, the polishing apparatus includes a turntable 10 and a wafer carrier 1, an enlarged view of which is shown in FIG. 5. The turntable 10 is provided on its upper surface with a polishing pad 11. The wafer carrier comprises a circular carrier body 2, a circular aerator member 3 secured on the under surface of the carrier body 2 and provided with a plurality of through holes 3*a* extending through the member 3, an annular backing member 4, the outer diameter of which is the same as that of the aerator member 3, secured on the periphery of the aerator member 3, and a circular guide ring 5, the outer diameter of which is the same as that of the carrier body 2, secured to the periphery of the lower surface of the carrier body 2 in such a manner that the lower surface of the circular guide ring 5 extends beneath the lower surface of the backing member 4. The backing member 4 is preferably formed from a non-permeable material such as silicon rubber, polyurethane, and polyethylene terephthalate and is preferably 0.5–1 mm in thickness. In this embodiment, the lower surface of the aerator 3 constitutes the "article holding surface" referred to in the summary of the invention noted above.

Figure 2:
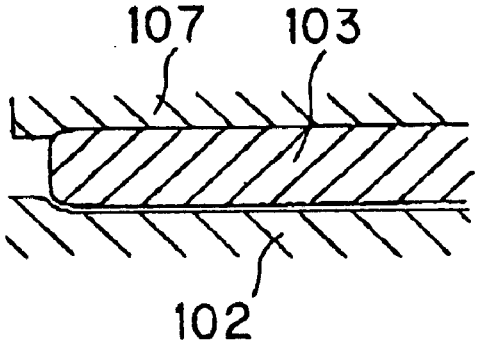
FIG. 2 is a sectional view showing an edge portion of a semiconductor wafer during a polishing operation.
Figure 3:
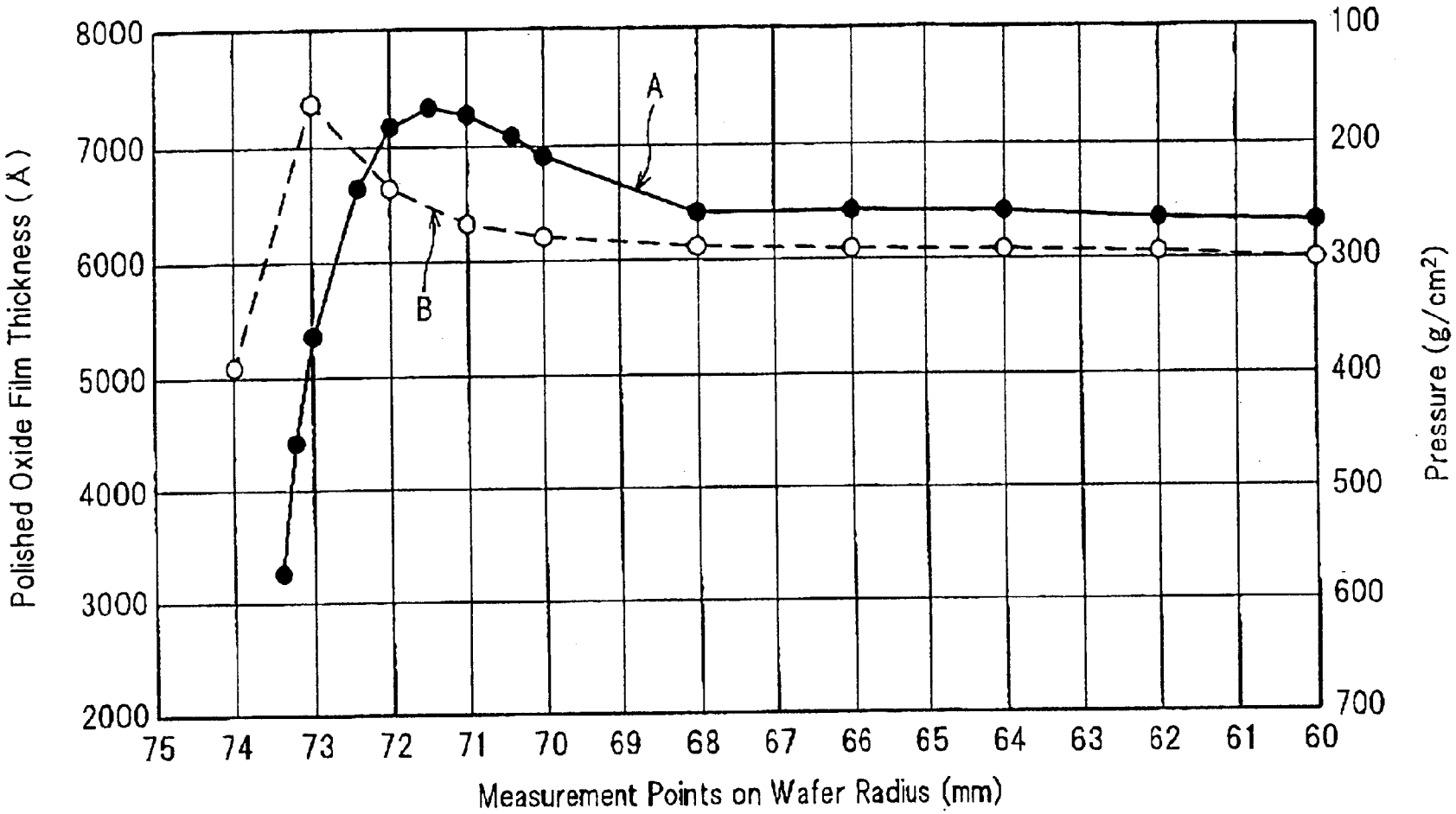
FIG. 3 is a graph showing a relationship between polishing rates at points along a radius of a polished wafer and differing pressures imposed on the polished wafer surface.
Figure 6:
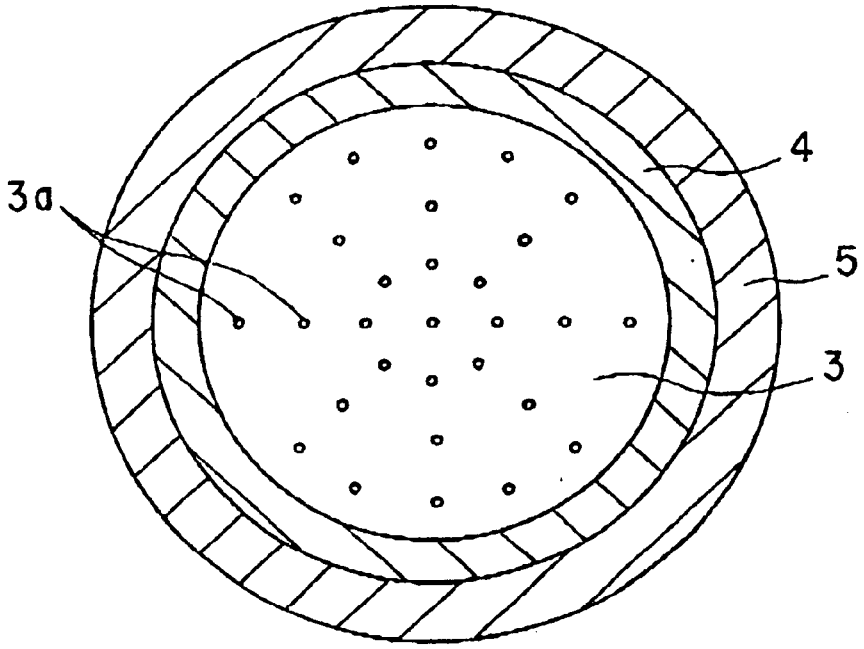
FIG. 6 is a bottom view of the wafer carrier of FIG. 5.

When conducting a polishing operation, a wafer 6 is held on the lower surface of the backing member 4 and pressed against the polishing cloth 11. Consequently, a chamber 9*a* is defined or confined by the aerator member 3, the backing member 4 and the wafer 6. On the upper surface of the aerator member 3, there is provided an upper recessed portion which forms a second chamber 9*b* underneath the lower surface of the carrier body 2. The chambers 9*a* and 9*b* are fluidly connected to each other through the holes 3*a*, and the second chamber 9*b* is fluidly connected to a hole 2*a* provided through the carrier body 2. The holes 3*a* are, as shown in FIG. 6, distributed in a predetermined pattern over the entire aerator member 3. It has been found that when the holes are provided only in the central area of the aerator member 3, excessive polishing of the edge of the wafer 6 as shown in FIG. 2 results. However, such excessive polishing can be avoided by additionally forming holes 3*a* in an area close to the backing member 4. It is possible for the holes 3*a* to be arranged along a plurality of coaxial circles which are positioned close to the backing member 4.

As shown in FIG. 4, the wafer carrier 1 is drivingly connected to a drive shaft 8 through a universal joint 7 in such a manner that the wafer carrier 1 is adapted to be rotated by the drive shaft 8 and to tilt relative to the drive shaft. The drive shaft 8 is supported by a support arm 12 in such a manner that the shaft is rotatable about its axis. The support arm 12 is provided on a pivotal shaft 19. The support arm 12 is provided with a motor 17 thereon which drives the drive shaft 8 through a drive train including a timing pulley 18 connected to the shaft of the motor 17, a timing pulley 15 secured to a sleeve 14 fixed on the drive shaft 8, and an endless timing belt 16 engaged with the timing pulleys 18 and 15. The support arm 12 further has an air cylinder drive 13 which is connected to the top of the drive shaft 8 through a piston 13' of the air cylinder drive 13 and a rod connecting the piston and the top of the drive shaft 8. The polishing apparatus further includes a pressurized air source 22 and a vacuum source 26 which are connected in parallel to the air cylinder drive 13 and the hole 2*a* of the carrier body 2 through a pressurized-air/vacuum supply circuit including pipes 20 and 21, pressure regulators R1 and R2, and valves $V_0$, $V_1$, and $V_2$. The polishing apparatus further includes an abrasive liquid supply nozzle 23 for supplying an abrasive liquid Q onto the polishing pad 11.

Figures 7, 7B:
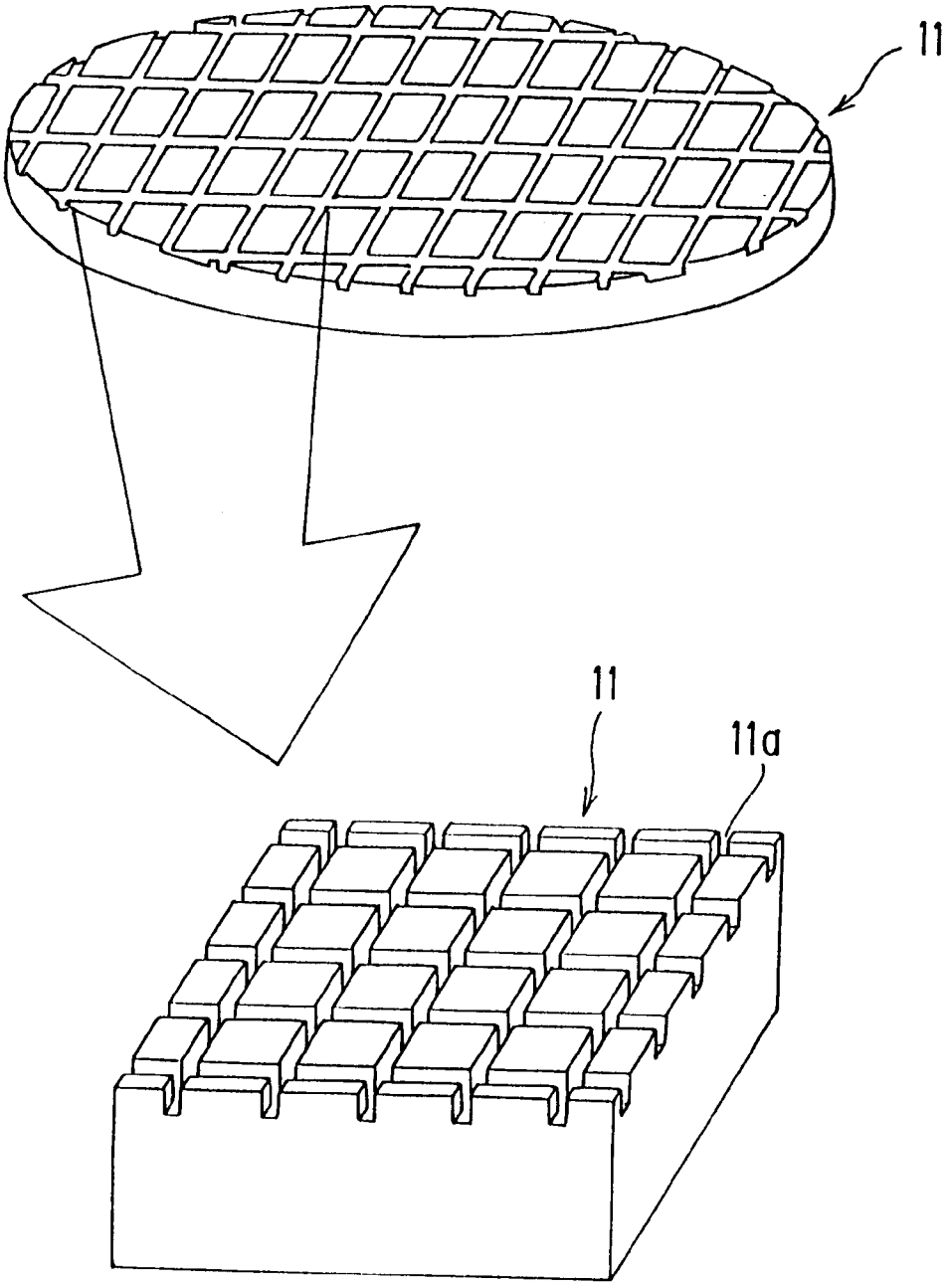
FIG. 7(*a*) is a perspective view of a polishing pad employed in the polishing apparatus of the first embodiment.

FIG. 7(*a*) shows a complete polishing cloth 11, while FIG. 7(*b*) shows a portion thereof in an enlarged view. As shown, the surface of the polishing cloth defining a polishing surface is provided with grooves 11*a* arranged in a grid-like pattern. For example, the grooves are 1 mm in width and depth and spaced from each other at a pitch of 5 mm. It is preferable for the grooves to be 0.3–2 mm in width and 0.1 mm or more in depth and spaced from each other at a pitch of 3–15 mm. Further, the grooves may be arranged in a different configuration such as in a plurality of coaxial circles.

During a polishing operation, a wafer 6 which is placed outside the turntable 10 is first picked up and securely held on the lower surface of the backing member 5 by a vacuum applied to the chamber 9*a* by means of the vacuum source 26 and then moved to a position above the polishing pad 11 on the turntable 10. The wafer carrier 1 is thereafter lowered by the cylinder drive 13 which is supplied with pressurized air from the pressurized air source 22 to thereby press the wafer 6 against the polishing pad 11. The vacuum in the chamber 9*a* is then replaced with pressurized air supplied by the pressurized air source 22, whereby the wafer 6 is further pressed against the polishing cloth 11 by the pressurized air. Switching between pressurized air and the vacuum is effected by operating the valves $V_1$, $V_2$ and $V_0$. Consequently, the wafer can be pressed against the polishing cloth indirectly with the pressurized air supplied to the cylinder drive 13 via the backing member 4 and directly with the pressurized air supplied to the chamber 9*a* of the carrier 1. The pressures of the pressurized airs supplied to the cylinder drive 13 and to the chamber 9*a* are respectively regulated by the regulators R1 and R2 which are controlled by a controller (not shown). The pressure applied to the wafer by the pressurized air supplied into the chamber 9*a* may be from about 90 to 200 (preferably from 90 to 120; more preferably from 100 to 110) percent of the pressure which is applied to the wafer through the backing member. During the polishing operation, the pressurized air is continuously supplied into the chamber 9*a* and sealed by the annular backing member 4.

Figure 1:
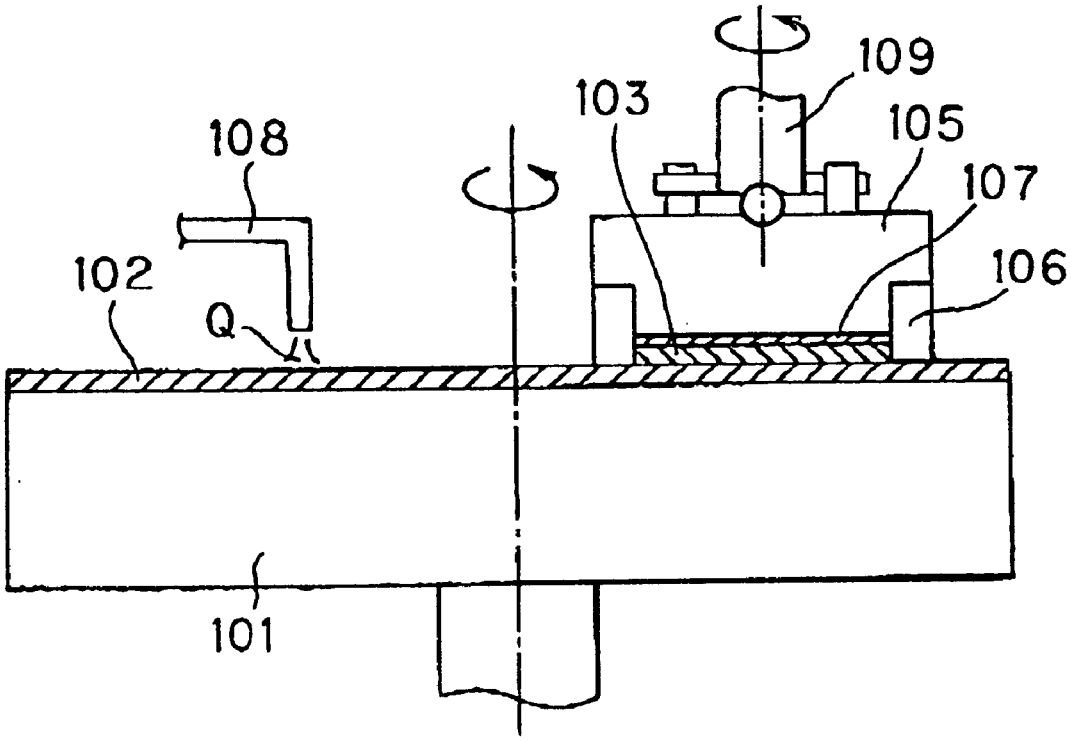
FIG. 1 is a sectional view of a turntable and a wafer carrier employed in a conventional manner.
Figure 8:
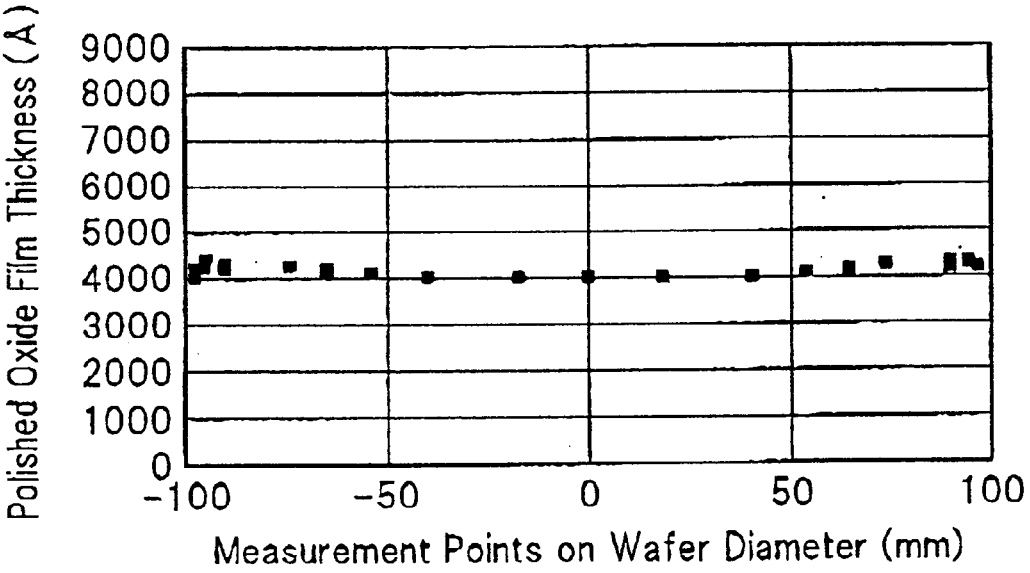
FIG. 8 is a graph showing the degree of flatness of a polished surface of a semiconductor wafer polished by the polishing apparatus in accordance with the first embodiment of this invention.
Figure 9:
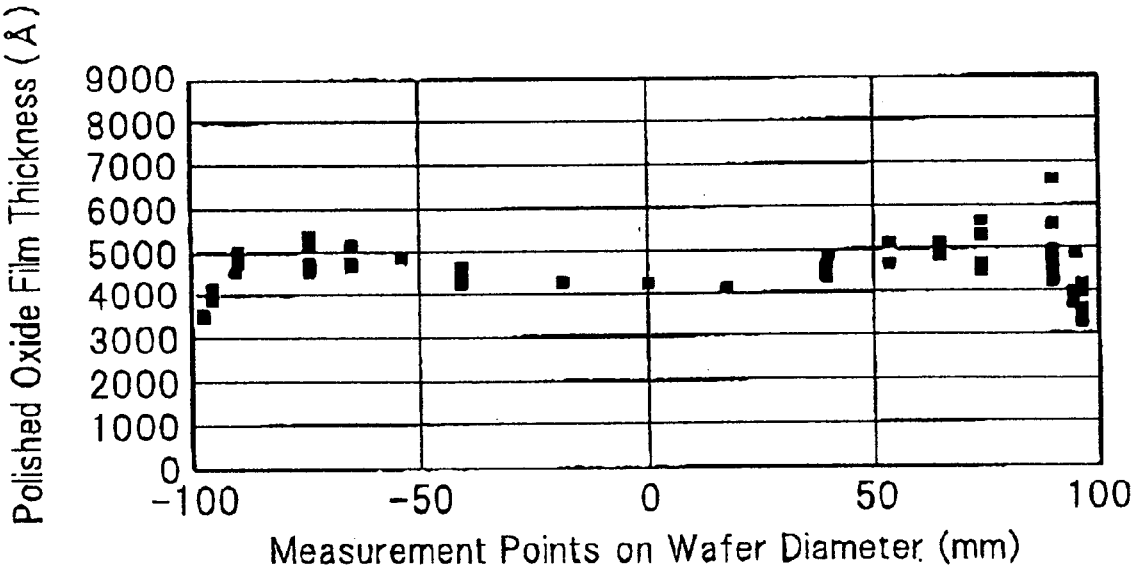
FIG. 9 is a graph showing the degree of flatness of a polished surface of a semiconductor wafer polished by a conventional polishing apparatus as shown in FIG. 1.

FIG. 8 is a graph showing a result of a polishing test in which an oxide layer formed over a surface of an 8 inch diameter semiconductor wafer was polished by a polishing apparatus in accordance with the present invention including the wafer carrier as shown in FIGS. 5 and 6, and the polishing cloth with grooves in the configuration of a grid as shown in FIG. 7(*a*) . In this graph, the vertical axis indicates the thickness of the oxide layer of the polished semiconductor wafer, and the horizontal axis indicates measurement points along a radius of the polished wafer with "0" indicating the center of the semiconductor wafer. FIG. 9 shows a result of a polishing test conducted with respect to the same wafer as that in the test shown in FIG. 8 using the conventional polishing apparatus as shown in FIG. 1. It is clear from these graphs that the polishing apparatus of the instant invention provides a significant improvement in the uniformity of the polishing or the degree of polished surface flatness as compared with the conventional polishing apparatus.

Figure 10:
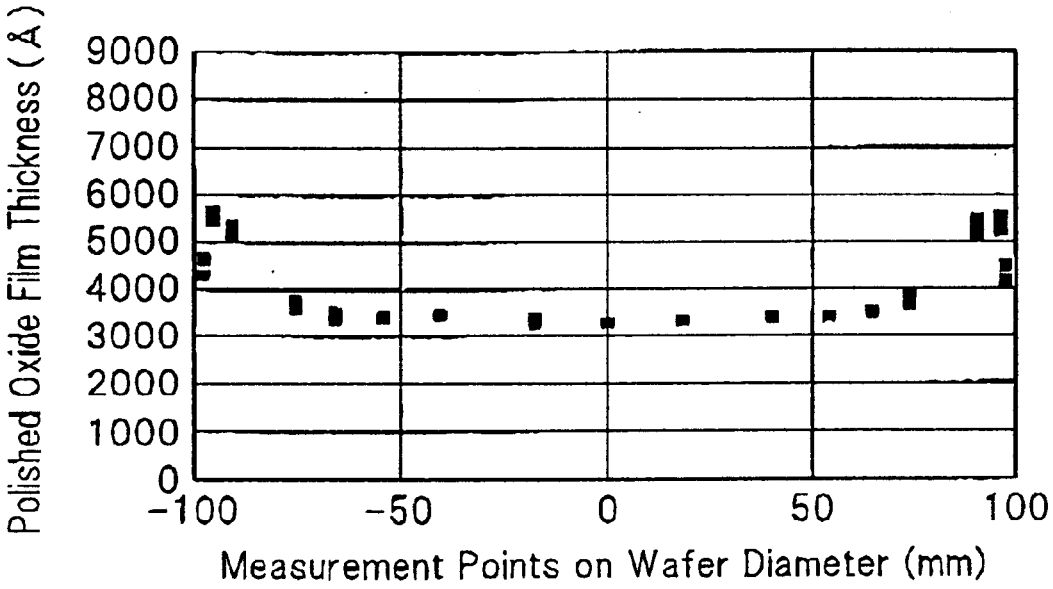
FIG. 10 is a graph showing the degree of flatness of a polished surface of a semiconductor wafer polished by a polishing apparatus including a polishing cloth provided with a number of punched holes distributed over the cloth and a wafer carrier as shown in FIGS. 5 and 6.
Figure 11:
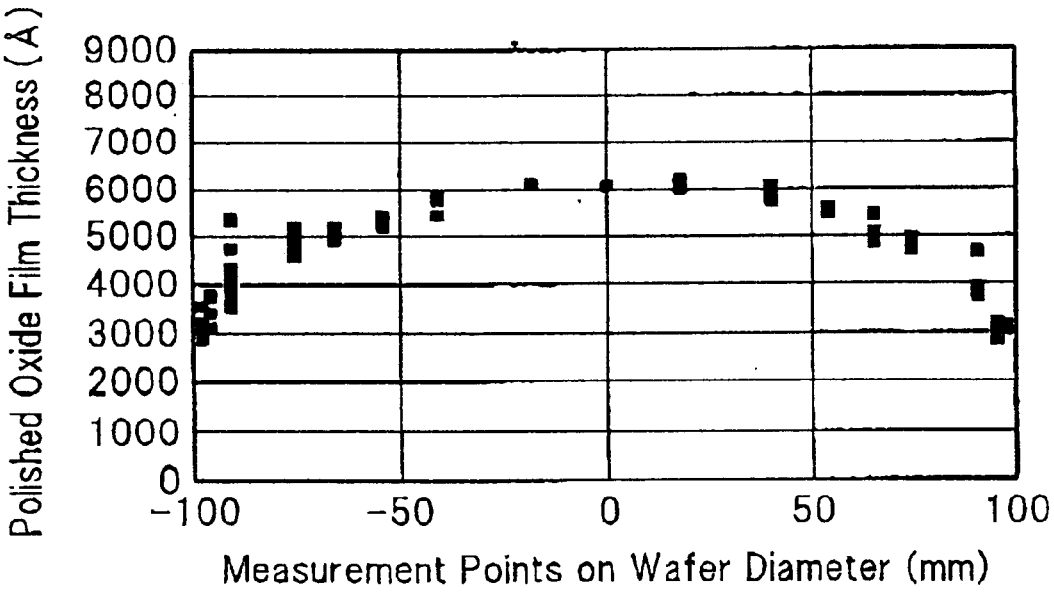
FIG. 11 is a graph showing the degree of flatness of a polished surface of a semiconductor wafer polished by a polishing apparatus including a polishing cloth as shown in FIG. 7(*a*) and a wafer carrier as shown in FIG. 1.

FIG. 10 shows a result of another polishing test which was carried about using a polishing apparatus in which a polishing cloth was provided with a number of punched holes distributed over the polishing cloth instead of the grooves as shown in FIG. 7(*a*), while a wafer carrier as shown in FIGS. 5 and 6 was used. FIG. 11 shows a result of a further polishing test which was conducted using a polishing apparatus in which a polishing cloth as shown in FIG. 7(*a*) is employed while a conventional wafer carrier as shown in FIG. 1 was used.

Those graphs show that the combination of the wafer carrier as shown in FIGS. 5 and 6 and the polishing cloth as shown in FIG. 7(*a*) attains a markedly better finishing of a polished surface or a high degree of flatness of a polished surface as compared with the others as noted above. It can be assumed that such superior polishing is attained by cooperation of a cushioning effect provided by the pressurized chamber 9*a* which eliminates any influence of non-uniformity in hardness of a disc-like backing member as used in the conventional polishing apparatus and as shown in FIG. 1, and a groove effect whereby the grooves formed in a polishing cloth as shown in FIG. 7(*a*) uniformly supply a sufficient amount of an abrasive liquid between a wafer and the polishing cloth and reduce a spring-back force of the polishing cloth which is imposed on the edge of the wafer by a portion of the polishing cloth which has just disengaged from the wafer and which is moved on the polishing pad while being polished. It should be noted that, in the tests referred to above, an alkaline slurry containing silica particles was used as an abrasive liquid. The provision of the grooves in the polishing cloth enables the surface of the polishing cloth to be readily restored to its original position when the polishing cloth is disengaged from a wafer being polished and to be readily fit to the surface of the wafer.

Figure 12:
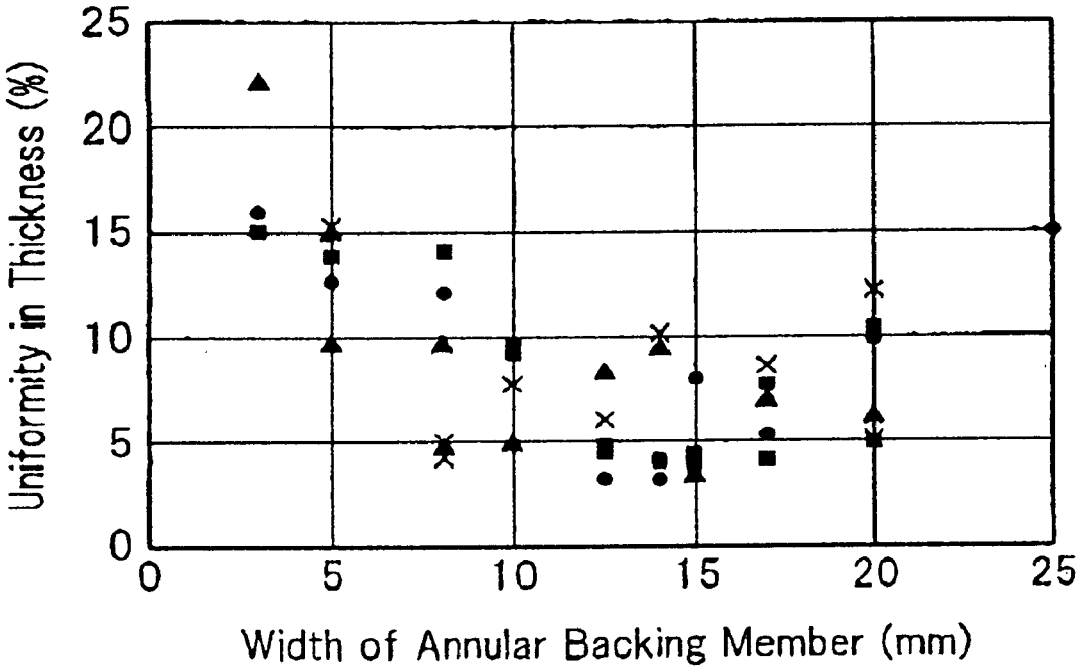
FIG. 12 is a graph showing relationships between the uniformity in flatness of polished wafer surfaces and the width of annular backing members used in a polishing apparatus of the instant invention.

FIG. 12 shows relationships between the uniformity in flatness of polished wafer surfaces and the width of the annular backing member 4. The uniformity varies depending on a variety of factors such as a pressing forces applied to a wafer through the backing member 4 and the pressurized chamber 9*a*, and the width of the annular backing member 4. FIG. 12 shows a result obtained in a test wherein the width of the backing member 4 was changed. In this figure, the marks of triangle, square, X and circle respectively indicate results of the test effected under predetermined pressures applied to the wafers which were set within a range of 0.8–2 kg/cm$^2$. In this test, the flatness of the polished surface at the outer peripheral area within 3 mm from the outer edge of the wafer is omitted from the measurement thereof. As can be seen from FIG. 12, the uniformity of the flatness is clearly improved when the width of the annular backing member is in a range of from 10 mm to 20 mm. It should be noted that, under certain pressures applied to the wafers, the uniformity was less than 5 percent.

Figure 13:
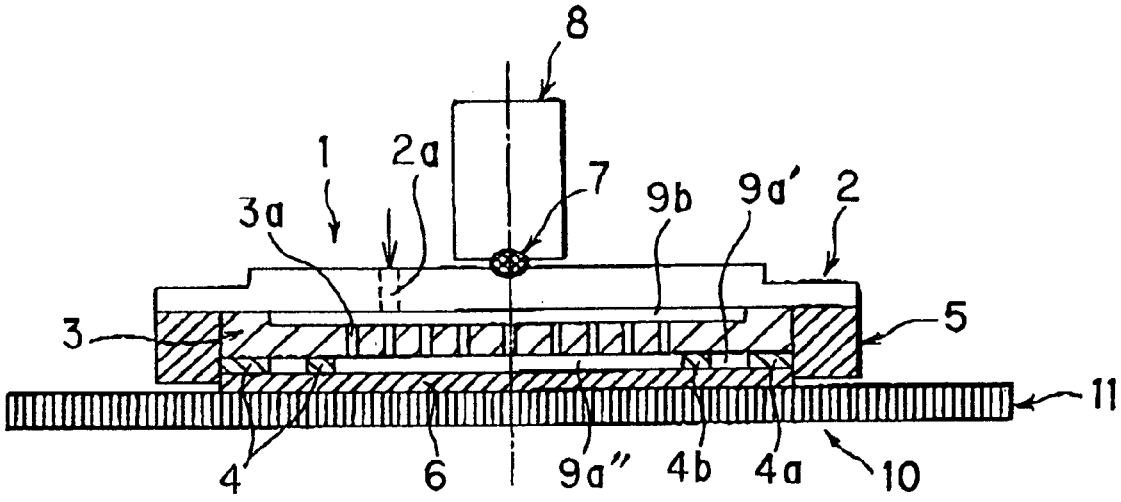
FIG. 13 is a sectional view of a wafer carrier in accordance with a second embodiment of this invention.
Figure 14:
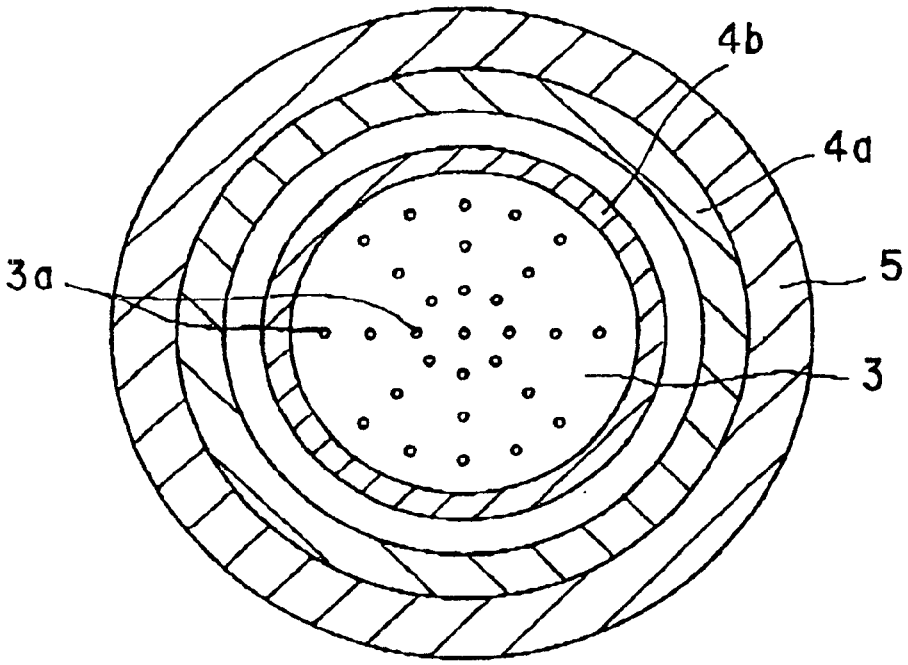
FIG. 14 is a bottom view of the wafer carrier of FIG. 13

FIGS. 13 and 14 show a wafer carrier in accordance with a second embodiment of this invention. As shown, the wafer carrier is different from that of the first embodiment shown in FIGS. 5 and 6 in that the former includes outer and inner annular backing members 4*a* and 4*b*. The outer annular backing member 4*a* is substantially the same as that in the first embodiment and secured to the lower surface of the aerator member 3 in the same manner. The inner annular backing member 4*b* is coaxially positioned radially inside and spaced away from the outer one 4*a*. As a result, the chamber 9*a* formed between the aerator member 3 and a wafer held by the wafer carrier is divided into an outer section 9*a'* and an inner section 9*a"*. As shown in FIG. 14, holes 3*a* are provided only inside the inner annular backing member 4*b* so that the holes 3*a* fluidly connects the chamber 9*b* to the chamber 9*a"*.

During a polishing operation, while slight leakage of pressurized air introduced into the chamber section 9*a"* into the chamber section 9*a'* occurs, such leakage does not have any substantial influence on a polishing effect. The pressure of the pressurized air supplied into the chamber section 9*a"* is controlled so that the pressurized air cooperates with the outer and inner backing members 4*a* and 4*b* to appropriately press the wafer 6 against the polishing pad 11 so as to enable the wafer to be uniformly polished.

In the second embodiment, the wafer carrier may includes at least one additional annular backing member provided coaxial with and inside the above-noted inner backing member 4*b*. Further, in the second embodiment, although it is preferable to form grooves in the surface of the polishing cloth 11 which enable the polishing apparatus to readily attain a high degree of flatness of a polished wafer surface, the polishing cloth may also includes a plurality of punched holes distributed over the polishing cloth in place of the grooves, and the material of the polishing cloth is not limited to any particular material. Incidentally, the inner annular backing member 4*b* may be formed from a plurality of segments arranged along a circle with each of the segments spaced away from the adjacent ones. In such a case, the pressures in the chambers 9*a'* and 9*a"* applied during a polishing operation become the same.

Figure 15:
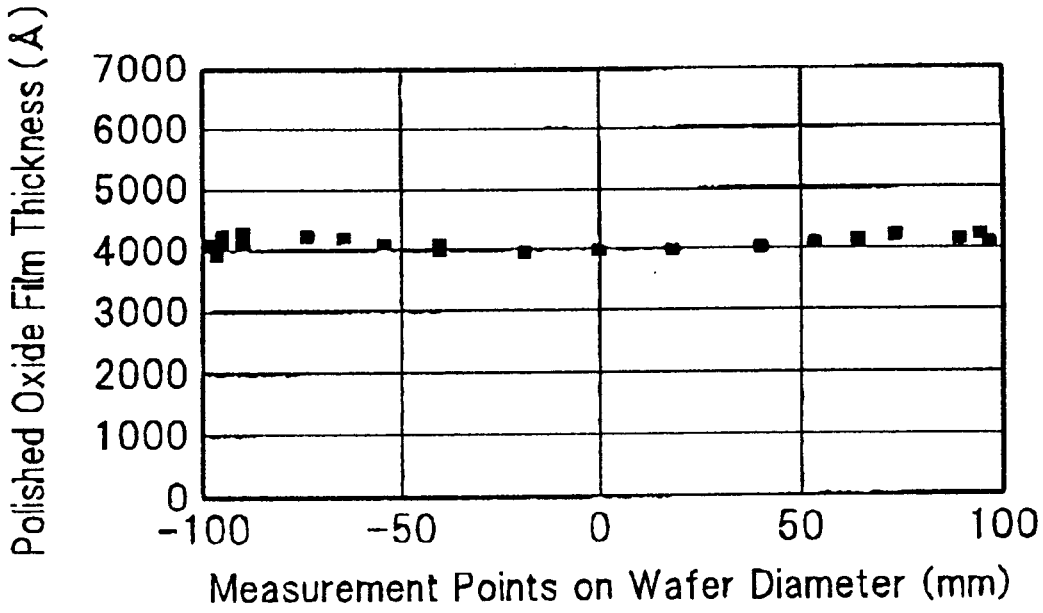
FIG. 15 is a graph showing the degree of flatness of a polished surface of a semiconductor wafer polished by the polishing apparatus in accordance with the second embodiment of this invention.

FIG. 15 is a graph similar to that of FIG. 9 and shows a result of a polishing test of a semiconductor wafer conducted using the wafer carrier as shown in FIGS. 13 and 14. The result shows that the wafer carrier attains a high degree of uniformity in polishing over the entire polished surface, as compared with that shown in FIG. 8.

Figure 16:
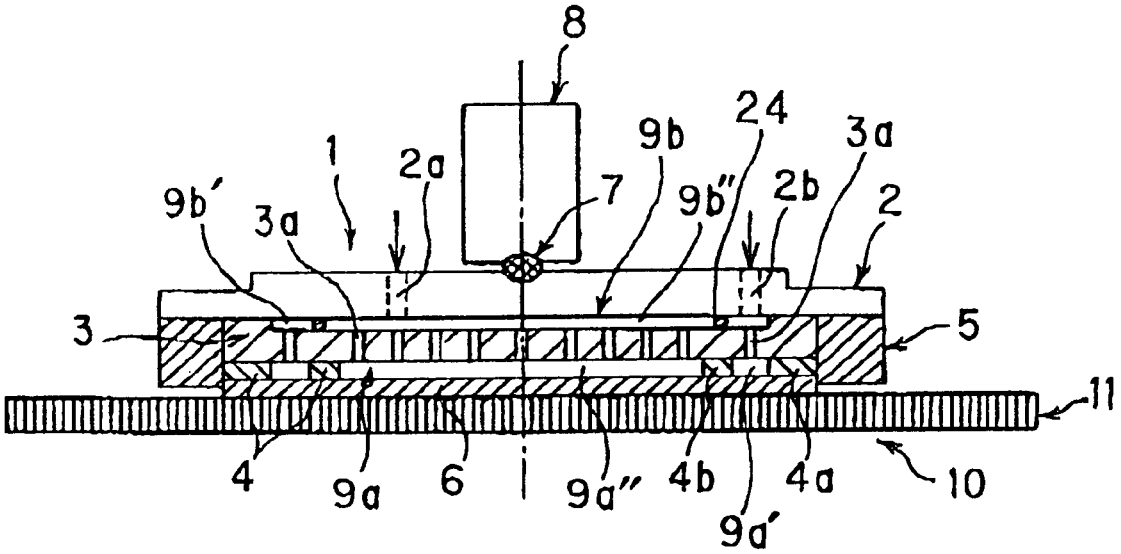
FIG. 16 is a sectional view of a wafer carrier in accordance with a third embodiment of this invention.
Figure 17:
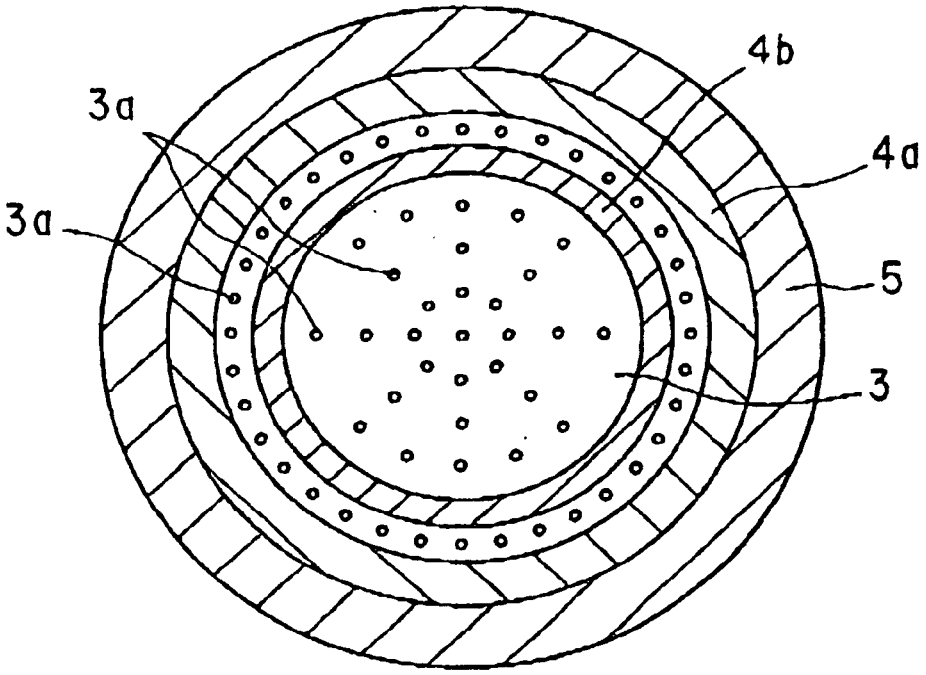
FIG. 17 is a bottom view of the wafer carrier of FIG. 16.
Figure 18:
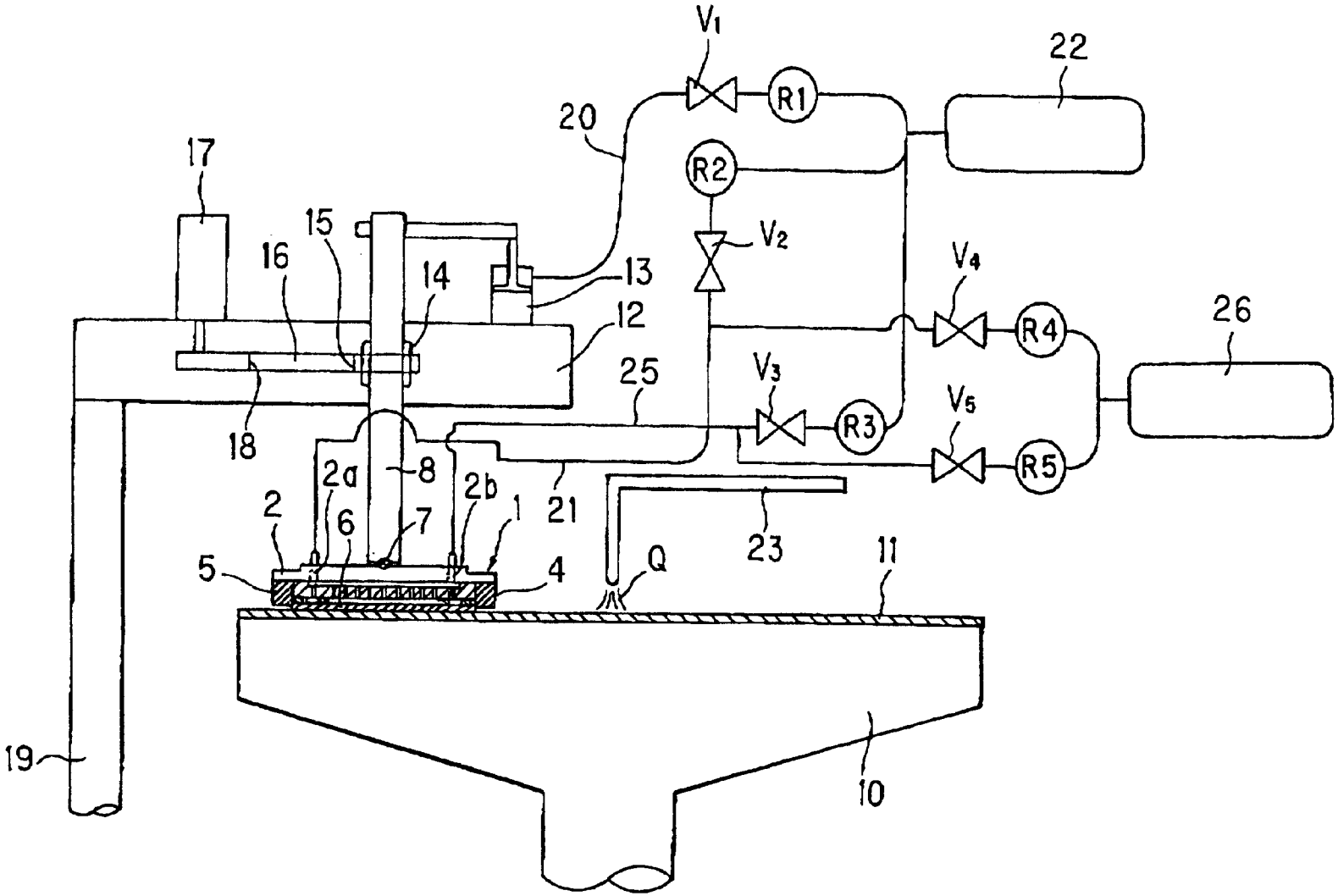
FIG. 18 is a schematic view of a polishing apparatus in accordance with the second embodiment of this invention.
Figure 19:
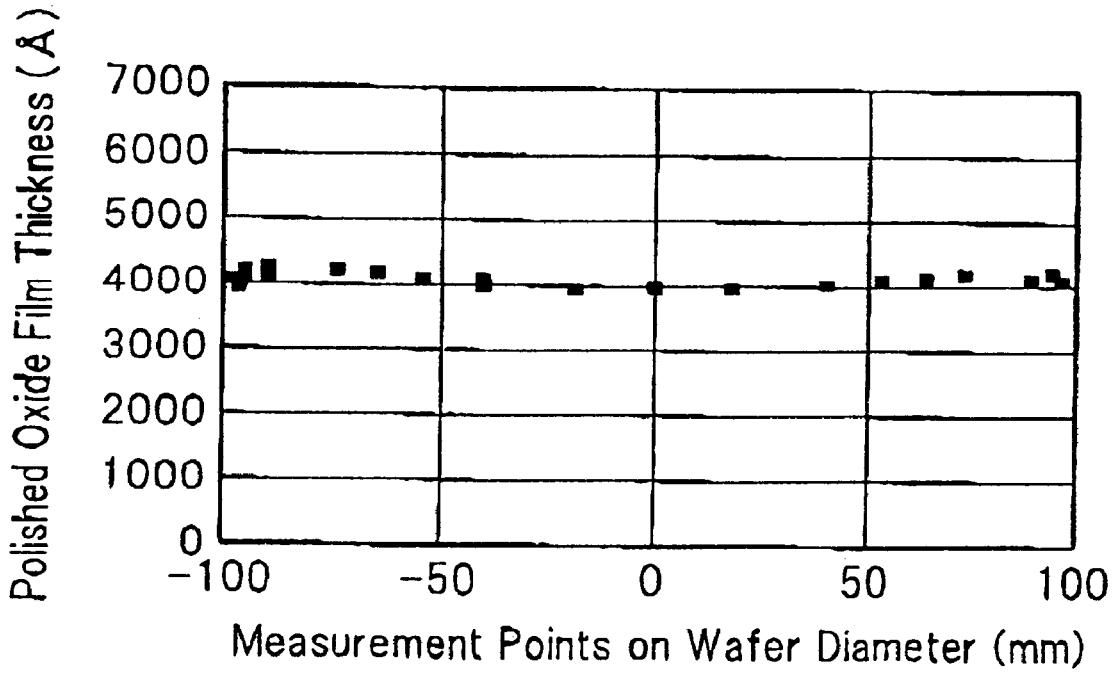
FIG. 19 is a graph showing the degree of flatness of a polished surface of a semiconductor wafer polished by the polishing apparatus in accordance with the third embodiment of this invention.

FIGS. 16 and 17 shows a wafer carrier in accordance with a third embodiment of this invention. As shown, the wafer carrier is generally the same as that of the second embodiment except that the former includes an O-ring 24 dividing the chamber 9*b* into outer and inner chamber sections 9*b'* and 9*b"*, and a plurality of holes 3*a* are additionally provided for fluidly communicating the chamber section 9*b'* with the chamber section 9*a'*. FIG. 18 shows a polishing apparatus which is generally the same as that shown in FIG. 4 except that the former includes an additional pressurized-air/vacuum supply circuit including lines extending from the pressurized air source 22 and the vacuum source 26 for selectively applying a pressurized air or a vacuum to the chamber section 9*b'* by operating regulators R3, R4 and R5 and valves $V_3$, $V_4$ and $V_5$ incorporated therein. In this embodiment, it is possible that pressures in the outer and inner chamber sections 9*a'* and 9*a"* are independently controlled by operating the regulators $R_2$ and $R_3$, whereby the wafer can be finished with a high degree of surface flatness as shown in FIG. 19. Since those skilled in the art will readily understand how those valves and regulators should be operated, a detailed explanation thereabout is omitted.

Figure 20:
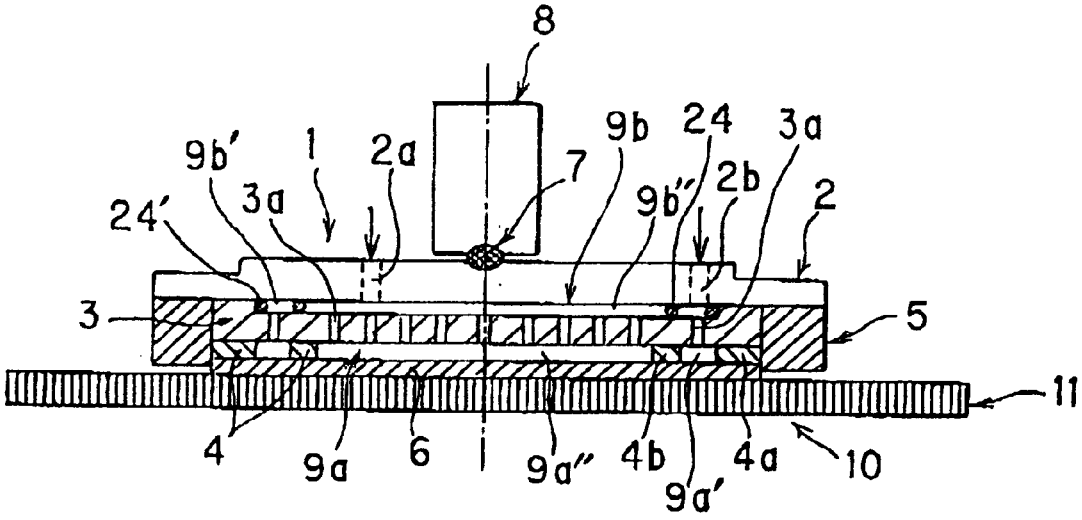
FIG. 20 is a sectional view of a wafer carrier in accordance with a fourth embodiment of this invention.
Figure 21:
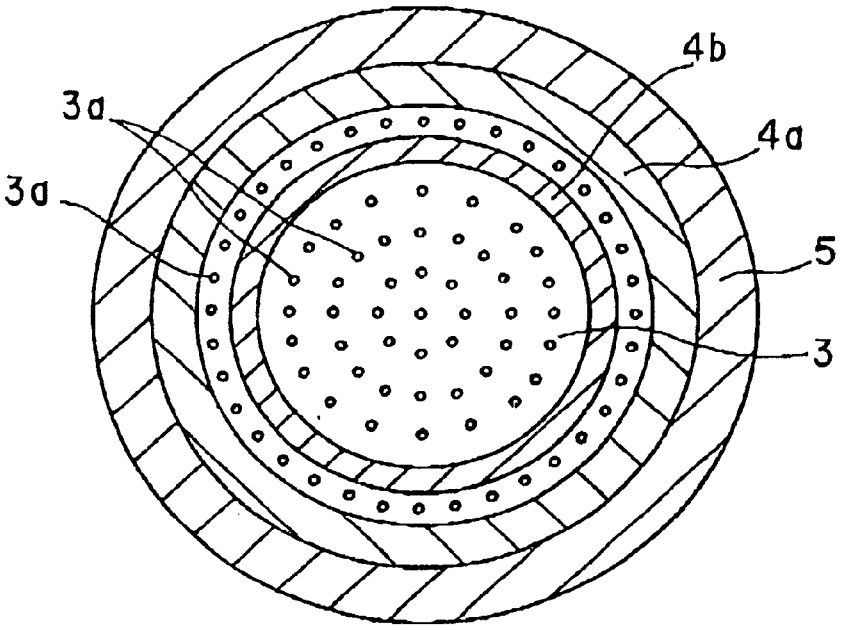
FIG. 21 is a bottom view of the wafer carrier of FIG. 20.
Figure 22:
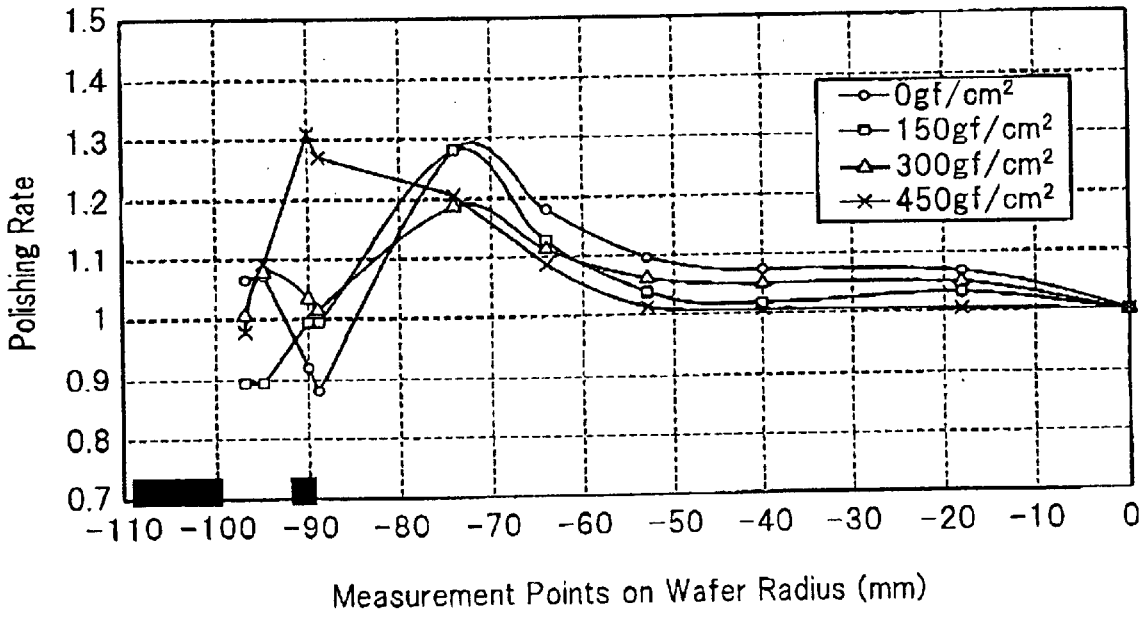
FIG. 22 is a graph showing a result of a test which was conducted using a polishing apparatus comprising a wafer carrier of the fourth embodiment and the polishing cloth as shown in FIG. 7(*a*).

FIGS. 20 and 21 show a variation of the wafer carrier as shown in FIGS. 16 and 17. The wafer carrier is different from that of FIGS. 16 and 17 in that many more holes 3*a* are provided inwardly of the annular inner backing member 4*b* than in the wafer carrier shown FIGS. 16 and 17, and an additional O-ring 24' is provided in the chamber 9*b* in such a manner that the ring engages with the peripheral wall of that chamber. FIG. 22 shows a result of a test which was conducted using a polishing apparatus comprising the wafer carrier of this variation, or fourth embodiment, and the polishing cloth as shown in FIG. 7(*a*). In this test, the pressure of the pressurized air supplied to the chamber section 9*a"* is maintained at 450 gf/cm$^2$ (44.1 kPa) and the pressure of the pressurized air supplied to the outer chamber section 9*a'* was set to have a variety of values as shown in FIG. 22, i.e., 0 gf/cm$^2$ (0 kPa), 150 gf/cm$^2$ (14.7 kPa), 300 gf/cm$^2$ (29.4 kPa) and 400 gf/cm$^2$ (39.2 kPa). FIG. 22 indicates the polishing rates at points along a radius of each of the wafers subjected to the test. The numeral "1" of the vertical axis of this graph indicates that the polishing rate at a measured point is the same as that measured at the center of the wafer. A numeral greater than "1" indicates that a polishing rate at a measured point is greater than that at the center of the wafer. It has been determined from FIG. 22 that the results of the test or the polishing rates shown are preferable. In contrast, it has been found that when the outer chamber section 9*a'* was provided with pressures greater than 450 gf/cm$^2$, the polishing rates or test results were not good when compared with the test results as stated above. It should therefore be noted that it is preferable for the inner chamber section 9" to be provided with a greater pressure than the outer chamber section 9*a'*. Specifically, it is preferable for the outer chamber section 9*a'* to be provided with a pressure of a magnitude of 0.5–0.8 times the pressure supplied to the inner chamber section 9*a"*.

In connection with the third and fourth embodiments, it has been found that it is preferable to make the width of the annular outer backing member 4*a* greater than that of the annular inner backing member to thereby obtain a higher degree of polished surface flatness. For example, in the above-noted test, the annular outer and inner backing members were 8 mm and 2 mm in width, respectively, and the spacing between these backing members was 7 mm.

It should be noted that the present invention is not necessarily limited to the foregoing embodiments but can be modified in a variety of ways without departing from the gist of the present invention. For example, it should be noted that the polishing cloth 11 is not limited to any particular material. Further, various materials can be used for the backing member 4, from a soft material such as polyurethane and rubber to a hard material such as a plastic including a fluorocarbon polymer (Teflon™). It is possible for a wafer to be provided on its upper surface, opposite the lower surface to be polished, with an annular protrusion corresponding to the backing member 4 to enable the chamber 9*a* to be formed without using the backing member 4.

What is claimed is:

1. A polishing apparatus comprising:

a turntable having a surface;

a polishing pad provided on said surface of said turntable, said polishing pad having a polishing surface provided with grooves formed therein to divide said polishing surface into a number of sections;

an article carrier having an article holding surface for holding thereon a plate-like article having a surface to be polished, said article carrier being adapted to press the surface of the plate-like article against said polishing surface of said polishing pad to polish and flatten the surface of the plate-like article by relative movement between the plate-like article and said polishing surface;

an annular member to be positioned between said article holding surface and the plate-like article to form a chamber defined by said annular member, said article holding surface and the plate-like article when the plate-like article is held by said article carrier; and a pressure control system to be fluidly connected to the chamber for controlling a pressure in the chamber.

2. The polishing apparatus according to claim 1, wherein said annular member is to be positioned along a peripheral edge of the plate-like article when the plate-like article is held by said article carrier.

3. The polishing apparatus according to claim 2, wherein when held by said article carrier, the plate-like article is to be pressed against said polishing surface with a pressure of pressurized fluid within the chamber while also being pressed against said polishing surface through said annular member.

4. The polishing apparatus according to claim 1, wherein said annular member has a width in a range of from 10 mm to 20 mm.

5. The polishing apparatus according to claim 1, wherein said grooves are arranged in a grid-like pattern.

6. A polishing apparatus comprising:

a turntable having a surface;

a polishing pad provided on said surface of said turntable, said polishing pad having a polishing surface;

an article carrier having an article holding surface for holding thereon a plate-like article having a surface to be polished, said article carrier being adapted to press the surface of the plate-like article against said polishing surface of said polishing pad to polish and flatten the surface of the plate-like article by relative movement between the plate-like article and said polishing surface;

an annular member to be positioned between said article holding surface and the plate-like article to form a chamber defined by said annular member, said article holding surface and the plate-like article when the plate-like article is held by said article carrier, said annular member having a width in a range of from 10 mm to 20 mm; and a pressure control system to be fluidly connected to the chamber for controlling a pressure in the chamber.

7. The polishing apparatus according to claim 6, wherein said annular member is to be positioned along a peripheral edge of the plate-like article when the plate-like article is held by said article carrier.

8. A polishing apparatus comprising:

a turntable having a surface;

a polishing pad provided on said surface of said turntable;

an article carrier having an article holding surface for holding thereon a plate-like article having a surface to be polished; and a member to be positioned between said article holding surface and the plate-like article to form a space between said holding surface and the plate-like article when the plate-like article is held by said article carrier, wherein said member is formed from a polyethylene terephthalate sheet.

9. A polishing apparatus comprising:

a turntable having a surface;

a polishing pad provided on said surface of said turntable, said polishing pad having a polishing surface;

an article carrier having an article holding surface for holding thereon a plate-like article having a surface to be polished, said article carrier being adapted to press the surface of the plate-like article against said polishing surface of said polishing pad to polish and flatten the surface of the plate-like article by relative movement between the plate-like article and said polishing surface;

a ring-shaped outer member to be positioned between said article holding surface and the plate-like article to form a chamber defined by said ring-shaped outer member, said article holding surface and the plate-like article when the plate-like article is held by said article carrier; and an inner member to be positioned inwardly of said ring-shaped outer member between said article holding surface and the plate-like article to divide the chamber into a plurality of chamber sections separated from each other, wherein said ring-shaped outer member is wider than said inner member.

10. The polishing apparatus according to claim 9, further comprising a pressure control system to be fluidly connected to the chamber to control pressures in said plurality of chamber sections, respectively.

11. A polishing apparatus comprising:

a turntable having a surface;

a polishing pad provided on said surface of said turntable, said polishing pad having a polishing surface;

an article carrier having an article holding surface for holding thereon a plate-like article having a surface to be polished, said article carrier being adapted to press the surface of the plate-like article against said polishing surface of said polishing pad to polish and flatten the surface of the plate-like article by relative movement between the plate-like article and said polishing surface;

a ring-shaped outer member to be positioned between said article holding surface and the plate-like article to form a chamber defined by said ring-shaped outer member, said article holding surface and the plate-like article when the plate-like article is held by said article carrier;

an inner member to be positioned inwardly of said ring-shaped outer member between said article holding surface and the plate-like article to divide the chamber into a plurality of chamber sections separated from each other; and a pressure control system to be fluidly connected to the chamber for controlling a pressure in the chamber.

12. A polishing apparatus comprising:

a turntable having a surface;

a polishing pad provided on said surface of said turntable, said polishing pad having a polishing surface;

an article carrier having an article holding surface for holding thereon a plate-like article having a surface to be polished, said article carrier being adapted to press the surface of the plate-like article against said polishing surface of said polishing pad to polish and flatten the surface of the plate-like article by relative movement between the plate-like article and said polishing surface;

a ring-shaped outer member to be positioned between said article holding surface and the plate-like article to form a chamber defined by said ring-shaped outer member, said article holding surface and the plate-like article when the plate-like article is held by said article carrier;

a ring-shaped inner member to be positioned inwardly of and coaxially with said ring-shaped outer member between said article holding surface and the plate-like article to divide the chamber into outer and inner chamber sections separated from each other; and a pressure control system to be fluidly connected to the chamber to control pressures in the inner and outer chamber sections, respectively.

13. The polishing apparatus according to claim 12, wherein said pressure control system includes regulators for controlling the pressures in the inner and outer chamber sections such that the pressure in the inner chamber section is greater than the pressure in the outer chamber section.

14. The polishing apparatus according to claim 12, wherein a ratio of the pressure in the inner chamber section to the pressure in the outer chamber section is to be from 1:0.5 to 1:0.8.

15. A polishing apparatus comprising:

a turntable having a surface;

a polishing pad provided on said surface of said turntable, said polishing pad having a polishing surface;

an article carrier having an article holding surface for holding thereon a plate-like article having a surface to be polished, said article carrier being adapted to press the surface of the plate-like article against said polishing surface of said polishing pad to polish and flatten the surface of the plate-like article by relative movement between the plate-like article and said polishing surface;

a ring-shaped outer member to be positioned between said article holding surface and the plate-like article to form a chamber defined by said ring-shaped outer member, said article holding surface and the plate-like article when the plate-like article is held by said article carrier; and an inner member to be positioned inwardly of said ring-shaped outer member between said article holding surface and the plate-like article to divide the chamber into a plurality of chamber sections separated from each other, wherein said ring-shaped outer member and said inner member each comprise a non-permeable material selected from the group consisting of silicon rubber, polyethylene, terephthalate, polyurethane, polyethylene and resist film.

16. A method of polishing a plate-like article, comprising:

holding an article with an article carrier;

defining a chamber by sealing a peripheral edge of said article with a sealing member of said article carrier; and pressing said article against a polishing surface of a polishing pad by pressurizing said chamber, wherein grooves are provided in said polishing surface to divide said polishing surface into a number of sections.

17. The method according to claim 16, wherein said grooves are arranged in a grid-like pattern.

18. The method according to claim 16, wherein said sealing member has a width in a range of from 10 mm to 20 mm.

* * * * *